US007004178B2

(12) United States Patent
Cornish

(10) Patent No.: US 7,004,178 B2
(45) Date of Patent: Feb. 28, 2006

(54) HAIR COLORING CAP HAVING LONG NARROW SLITS

(76) Inventor: Lisa Ann Cornish, 3154 Michigan St., Longview, WA (US) 98632

( * ) Notice: Subject to any disclaimer, the term of this patent is extended or adjusted under 35 U.S.C. 154(b) by 766 days.

(21) Appl. No.: 09/782,371

(22) Filed: Feb. 12, 2001

(65) Prior Publication Data

US 2002/0108625 A1 Aug. 15, 2002

(51) Int. Cl.
*A45D 19/18* (2006.01)

(52) U.S. Cl. ..... 132/270

(58) Field of Classification Search ..... 132/270, 132/54, 212, 207, 208, 274, 319; 2/174, 2/68, 181.6, 182.8; D28/19, 20, 93
See application file for complete search history.

(56) References Cited

U.S. PATENT DOCUMENTS

| | | | | | |
|---|---|---|---|---|---|
| 2,618,274 | A | * | 11/1952 | Nell | 132/270 |
| 2,957,480 | A | * | 10/1960 | Widoff et al. | 132/208 |
| 3,103,933 | A | * | 9/1963 | Sanzo | 132/270 |
| 3,304,945 | A | * | 2/1967 | Anderson | 132/270 |
| 3,390,689 | A | | 7/1968 | Newman | |
| 3,586,009 | A | | 6/1971 | Sirmons | |
| 3,692,032 | A | * | 9/1972 | Regas | 132/212 |
| 4,144,897 | A | * | 3/1979 | Mosz | 132/270 |
| 4,155,369 | A | | 5/1979 | Guinan | |
| 4,165,754 | A | | 8/1979 | Pasqua | |
| RE30,305 | E | | 6/1980 | Caruso | |
| 4,224,954 | A | | 9/1980 | Stahl | |
| 4,267,850 | A | | 5/1981 | Barrett | |
| 4,289,150 | A | | 9/1981 | Kimball | |
| 4,357,951 | A | | 11/1982 | Aricco | |
| 4,724,852 | A | | 2/1988 | Ramik | |
| D306,356 | S | | 2/1990 | Ramik | |
| D334,247 | S | | 3/1993 | Scianna | |
| 5,524,650 | A | | 6/1996 | Ponce | |
| 5,562,111 | A | | 10/1996 | Torres | |

* cited by examiner

*Primary Examiner*—Eduardo C. Robert
*Assistant Examiner*—David Cornstock
(74) *Attorney, Agent, or Firm*—Kurt M. Rylander

(57) ABSTRACT

A hard head foil cap is provided for foiling hair on an individual, and comprises a head cap provided with a plurality of long narrow slits each having an opening with a width in the range of 1/64" to 1/4". The slits are spaced around the head cap in two or more orientations. Hair shanks may be pulled through the slits for coloring, foiling, highlighting, or bleaching. A hard head foil cap for imparting designs to hair using a head cap with a plurality of long narrow slits spaced around the cap in two or more orientations, the slits configured to form designs to impart the designs in the highlighted hair. A hard head foil cap made by the process of providing an existing, mass manufactured hair cap with a plurality of long narrow slits spaced around the cap in two or more orientations. A method of treating hair.

10 Claims, 2 Drawing Sheets

Fig. 2
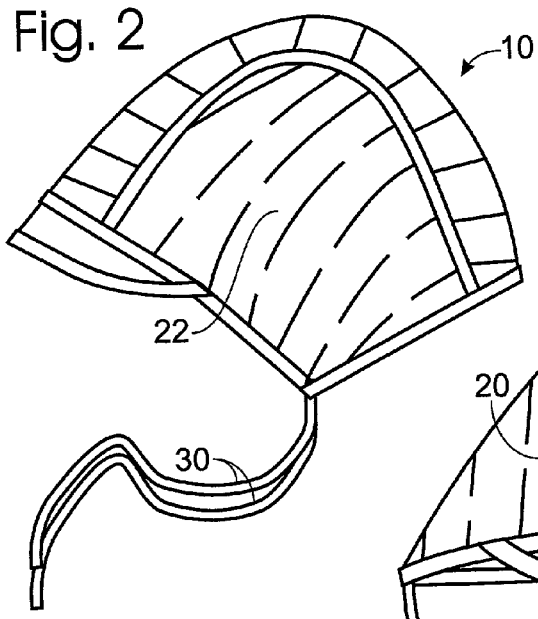
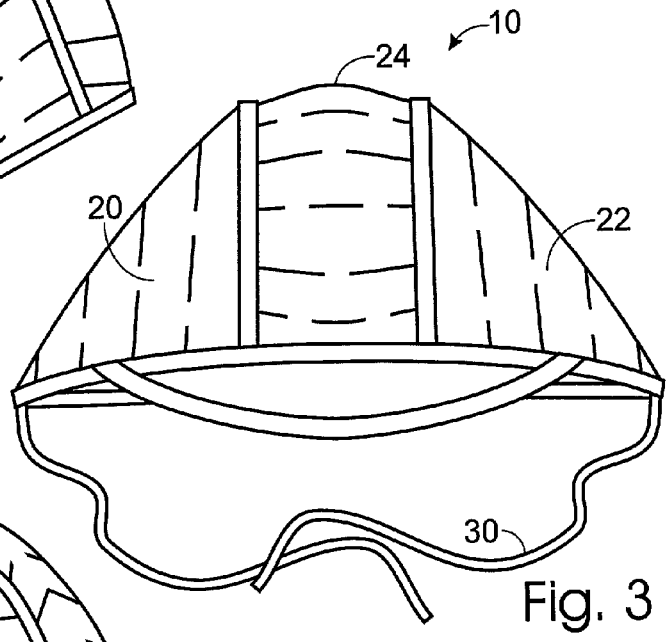
Fig. 3
Fig. 4
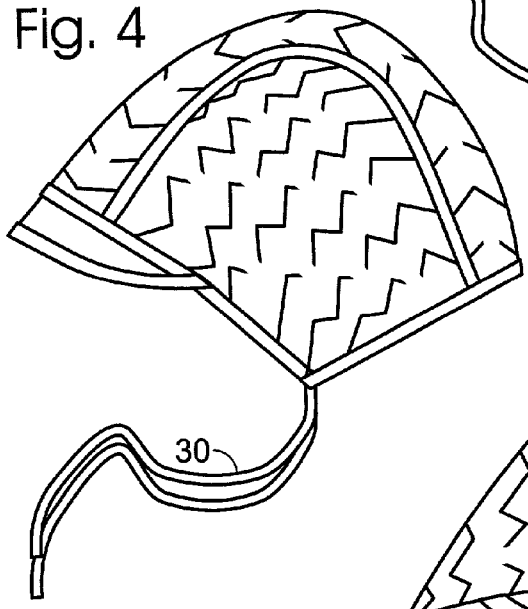
Fig. 5
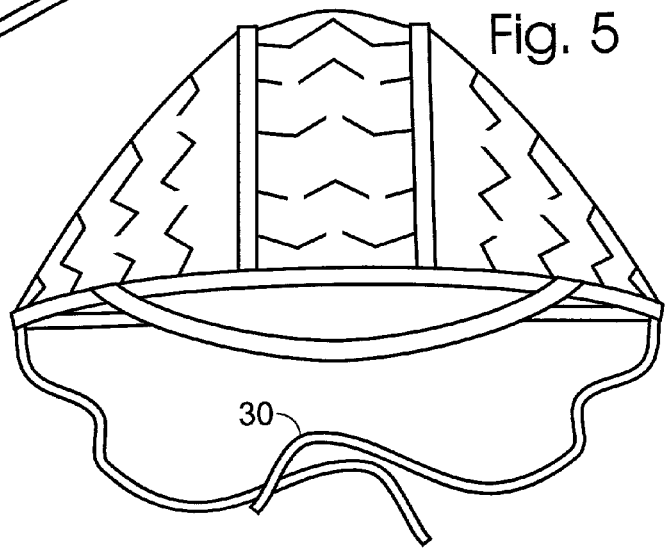

HAIR COLORING CAP HAVING LONG NARROW SLITS

FIELD OF THE INVENTION

The present invention relates to hair dressing products and more particularly to methods and articles for coloring hair.

BACKGROUND

Individuals for cosmetic and other reasons have their hair highlighted, colored, foiled, frosted, dyed, and bleached, among other things. Methods and articles for treating hair include the use of frosting tip caps, which are caps that have a plurality of holes and apertures spaced around the cap, the cap is then placed on the head of the individual desiring hair treatment, the individuals' hair is pulled through the holes, a few strands at a time, and the strands are then foiled. The process is time consuming and painful, and does not allow for ease of pattern and design creating in the treated hair.

Heretofore, an article and method for foiling hair using a head cap with a plurality of long narrow slits spaced around the cap in two or more orientations to allow locks of hair to be foiled together has not previously been provided. An article and method for imparting designs to hair using a head cap with a plurality of long narrow slits spaced around the cap in two or more orientations, said slits configured to form designs in the highlighted hair has not previously been provided.

The following represents a list of known related art:

U.S. Pat. No. 5,562,111 issued to Torres, Oct. 8, 1996;
U.S. Pat. No. 5,524,650, issued to Ponce, Jun. 11, 1996;
U.S. Pat. No. 4,724,852, issued to Ramik, Feb. 16, 1988;
U.S. Pat. No. 4,357,951 issued to Aricco, Nov. 9, 1982;
U.S. Pat. No. 4,289,150 issued to Kimball, Sep. 15, 1981;
U.S. Pat. No. 4,267,850 issued to Barrett, May 19, 1981;
U.S. Pat. No. 4,224,954 issued to Stahl, Sep. 30, 1980;
U.S. Pat. No. 4,165,754 issued to Pasqua, Aug. 28, 1979;
U.S. Pat. No. 4,155,369, issued to Guinan, May 22, 1979;
U.S. Pat. No. 3,586,009, issued to Sirmons, Jun. 22, 1971;
U.S. Pat. No. 3,390,689, issued to Newman, Jul. 2, 1968;
U.S. Design Pat. No. 334,247, issued to Scianna, Mar. 23, 1993;
U.S. Design Pat. No. 306,356, issued to Ramik, Feb. 27,1990; and
U.S. Reissue Pat. No. 30,305, issued to Caruso, Jun. 17,1980.

The teachings of each of the above-listed citations (which does not itself incorporate essential material by reference) are herein incorporated by reference. None of the above inventions and patents, taken either singularly or in combination, is seen to describe the instant invention as claimed. Thus solving the aforementioned problems is desired.

Therefore, it is highly desirable to create an article and method for an article and method for foiling hair using a head cap with a plurality of long narrow slits spaced around the cap in two or more orientations to allow locks of hair to be foiled together. It is further highly desirable to create an article and method for imparting designs to hair using a head cap with a plurality of long narrow slits spaced around the cap in two or more orientations, said slits configured to form of designs in the highlighted hair. It is further highly desirable to create a head cap by providing an existing, mass manufactured hair cap it with a plurality of long narrow slits spaced around the cap in two or more orientations.

Potential customers for articles and methods that meet these objects include individuals who color, foil, and highlight their own hair, hair salons, barber shops, hair stylists, cosmetologists, film companies, model agencies, and any entity which uses or performs hair coloring, foiling, designing, or styling.

OBJECTS AND SUMMARY

Accordingly, it is an object to provide novel articles and methods for solving the above-mentioned problems. In particular, it is an object to provide an article and method for foiling hair using a head cap with a plurality of long narrow slits spaced around the cap in two or more orientations to allow locks of hair to be foiled together. It is a further object of the present invention to provide an article and method for imparting designs to hair using a head cap with a plurality of long narrow slits spaced around the cap in two or more orientations, said slits configured to form of designs to impart said designs in the highlighted hair. It is a further object of the present invention to create a head cap by providing an existing, mass manufactured hair cap it with a plurality of long narrow slits spaced around the cap in two or more orientations. It is a further object of the invention to provide improved elements and arrangements thereof for the purposes described which is inexpensive, dependable and fully effective in accomplishing its intended purposes. These and other objects of the present invention will become readily apparent upon further review of the following specification and drawings.

To achieve the objects and in accordance with the purpose of the invention, as embodied and broadly described herein, a hard head foil cap is provided. The hard head foil cap comprises a head cap provided with a plurality of long narrow slits cut into the head cap in two or more orientations such that shanks of hair can be pulled through any such slit for hair coloring. The slits can be placed about the cap in different orientations to create different treatment of, and designs in, the hair of the wearer. A method is further provided for treating hair.

The accompanying drawings, which are incorporated in and constitute a part of this specification, illustrate one embodiment of the invention and, together with the description, serve to explain the principles of the invention.

The novel articles and methods provide a number of advantages. The present invention improves the manner of highlighting hair and replaces the process of foiling hair with weaving or block foiling methods and has the advantage of reducing mess, eliminating the step of needing to cut foils, and providing more control to the stylist. The present invention is faster, more efficient, and takes less time to complete as compared to existing foil procedures. Moreover, pursuant to an embodiment of the present invention, long narrow slits spaced evenly eliminate the need to part the hair. The desired amount of hair is pulled through the slits using a hair needle for block foiling, or weave the hair that is pulled through for a foil effect.

Further advantage obtains in that cap of the present invention gives more control of the amount of hair that is pulled out, leaving the remainder of the hair protected by the cap without bleeding. Color and/or bleach is then applied to the hair that has been pulled through the slit to achieve the desired shade.

Moreover, advantage obtains in that the cap of the present invention allows the long narrow slits to be made on the cap in various designs such a zigzag design. The placement of slits themselves can create a design, as can the cut of the slit. The slit can be a zigzag, for example, or a wavy line. This creates the effect of highlighting the hair in different patterns. Similarly, the present invention can have a logo design cut into the cap. This allows logos to be colored onto the individual's hair.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

FIG. 2 shows a side view of an embodiment of the present invention.

FIG. 3 shows a frontal view of an embodiment of the present invention.

FIG. 4 shows a side view of another embodiment of the present invention.

FIG. 5 shows a frontal view of another embodiment of the present invention

DETAILED DESCRIPTION

Figure 1:
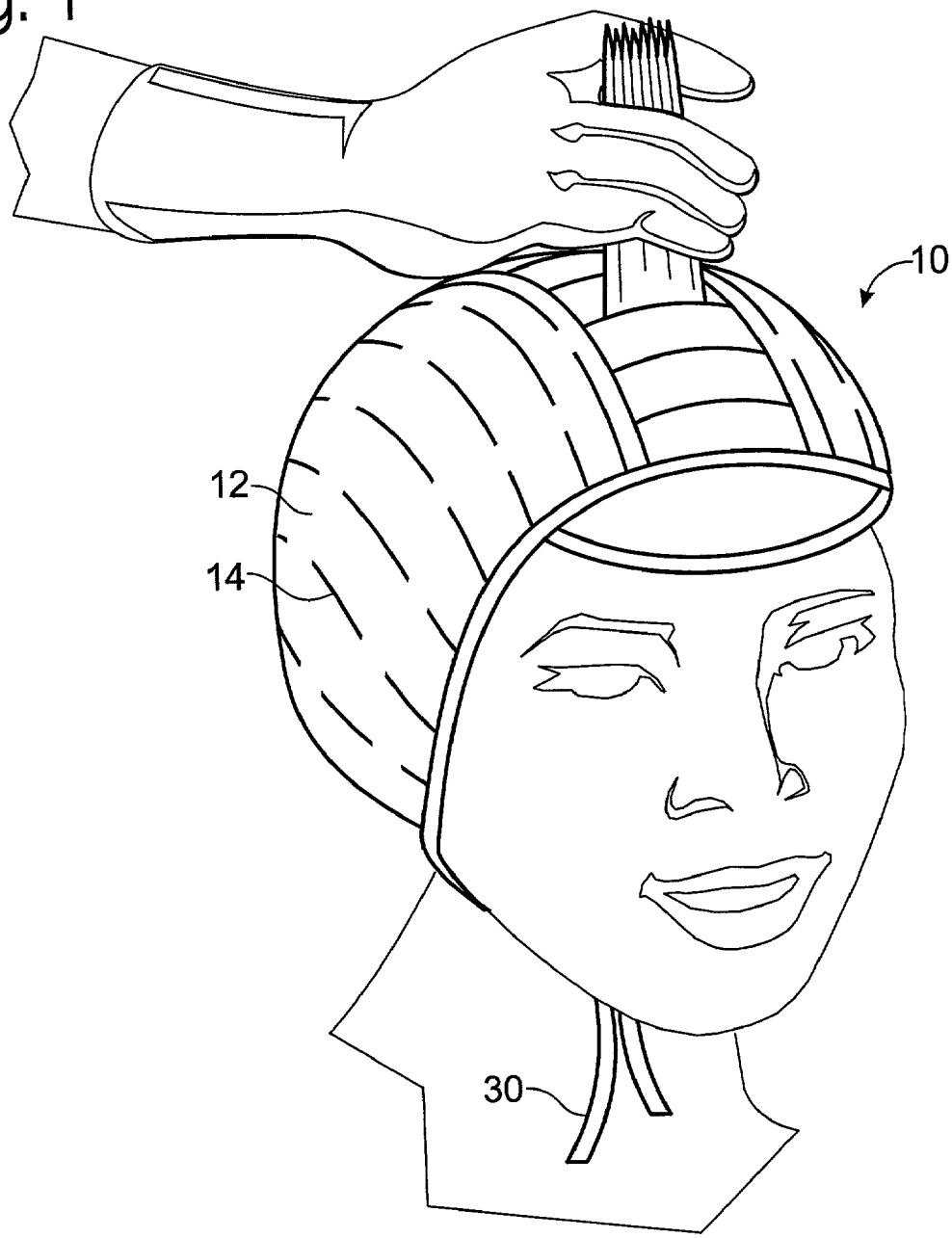
FIG. 1 shows an embodiment of the present invention in operation.

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

Turning now to a discussion of the present invention, as shown in FIG. 1, a hard head foil cap 10 is provided for hair coloring. The hard head foil cap comprises a head cap 12 with a plurality of long narrow slits 14 cut into the head cap in two or more orientations such that shanks of hair can be pulled through any such slit for hair coloring. The head cap is flexible and conformable about the head of the person whose hair is to be treated and covers said head from the top of the forehead to the nape of the neck, with slits along the top 24 and along the sides 20 and 22. The slits can be reinforced. Such reinforcement may include adding stitching the slits or adding thicker plastic around the slits. Alternatively, the slits can be configured in a zip lock fashion such that the slit can be partially closed to tighten the slit upon the shank of the hair creating the additional firmness needed to keep hair secure when pulled through the sits. Zip lock refers to interlocking seams for a linear press-closure which holds together by interference between two linear elements of either side of the seal, with or without a movable closure element, such as those sold under the trademark ZIPLOC.

Said cap may be made of plastic, foam, rubber, or fabric which is waterproof. Said cap can be provided with tying straps 30 extending from the cap to be tied under the chin of the wearer, as depicted in FIGS. 1, 2, 3, 4 and 5. Slit length is in the range of 1" to 4". Slit width is in the range of 1/64" to 1/4". Slit spacing is in the range of 1/2" to 2" between slits. The preferred embodiment of the present invention has slits from forehead to nape, spaced 1" to 1 1/4" apart, with the slits each between 3" and 3 1/2" long and 1/16" to 1/4" wide. In the preferred embodiment, on the side of the cap, the slits are 2" long, running horizontal, and spaced 3/4" to 1 1/4" apart.

The slits can be straight, or cut in any desired shape for aesthetic purposes. As shown in FIGS. 4 and 5, the slits can be cut in a zigzag pattern. Those skilled in the art will know that the slits can be spaced apart in many different configurations. Those skilled in the art will know that the slits can be oriented in many different directions. In the preferred embodiment, the slits on the sides of the cap are oriented horizontally, running, in relation to the head of the individual, roughly face to back, and on the top of the head, from side to side.

In operation, hair is colored, frosted, foiled, highlighted, or bleached by placing the hard head foil cap of the present invention over the hair of the person whose hair is to be colored, pulling shanks of hair through the slits, as shown in FIG. 1, and coloring, frosting, foiling, highlighting, or bleaching said hair shank. The process is repeated as desired around the head. For logos, color hairspray is preferred.

Those skilled in the art will recognize that numerous modifications and changes may be made to the preferred embodiment without departing from the scope of the claimed invention. It will of course be known that the present invention is equally applicable to hair dying, foiling, coloring, bleaching, painting, and other hair treatments, and the present invention is not limited to a particular type of hair treatment. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are also possible, their specific designs depending upon the particular application. The scope of the invention should not be limited by the particular embodiments herein described but should be defined only by the appended claims and equivalents thereof.

I claim:

1. A hard head foil cap, comprising:

a. a head cap; and b. a plurality of long narrow slits cut into the head cap such that shanks of hair can be pulled through any such slit for hair coloring, and wherein the slits have width in the range of 1/64" to 1/4", and wherein said slits are zig-zag shaped.

2. A hard head foil cap, comprising:

a. a head cap made of plastic, foam, or rubber, or waterproof fabric; and b. a plurality of long narrow slits cut into the head cap such that shanks of hair can be pulled through any such slit for hair coloring, and wherein the slits have width in the range of 1/64" to 1/4", and wherein said slits are zig-zag shaped.

3. A hard head foil cap, comprising:

a. a head cap; and b. a plurality of long narrow slits cut into the head cap such that shanks of hair can be pulled through any such slit for hair coloring, and wherein the slits have width in the range of 1/64" to 1/4", and wherein the slits are configured with interlocking seams for a linear press-closure which holds together by interference between two linear elements of either side of the seal such that the slit can be partially closed to tighten the slit upon the shank of the hair.

4. A hard head foil cap, comprising:

a. a head cap made of plastic, foam, or rubber, or waterproof fabric; and b. a plurality of long narrow slits cut into the head cap such that shanks of hair can be pulled through any such slit for hair coloring, and wherein the slits have width in the range of 1/64" to 1/4", and wherein the slits are configured with interlocking seams for a linear press-closure which holds together by interference between two linear elements of either side of the seal such that the slit can be partially closed to tighten the slit upon the shank of the hair.

5. A hard head foil cap, comprising:

a. a head cap, wherein said cap is made of plastic, foam, or rubber, or waterproof fabric; and b. a plurality of long narrow slits cut into the head cap such that shanks of hair can be pulled through any such slit, and wherein the slits are configured in two or more orientations, wherein the slits have length in the range of 1" to 4" and width in the range of 1/64" to 1/4", and wherein the slits are spaced apart with spacing in the range of 1/2" to 2", wherein said slits are zig-zag shaped.

6. A hard head foil cap, comprising:

a. a head cap, wherein said cap is made of plastic, foam, or rubber, or waterproof fabric; and b. a plurality of long narrow slits cut into the head cap such that shanks of hair can be pulled through any such slit, and wherein the slits are configured in two or more orientations, wherein the slits have length in the range of 1" to 4" and width in the range of 1/64" to 1/4", and wherein the slits are spaced apart with spacing in the range of 1/2" to 2", and wherein said slits are zig-zag shaped and the slits are reinforced by one of the group selected from stitching the slits and adding thicker plastic around the slits.

7. A hard head foil cap, comprising:

a. a head cap, wherein said cap is made of plastic, foam, or rubber, or waterproof fabric; and b. a plurality of long narrow slits cut into the head cap such that shanks of hair can be pulled through any such slit, and wherein the silts are configured in two or more orientations, wherein the slits have length in the range of 1" to 4" and width in the range of 1/64" to 1/4", and wherein the slits are spaced apart with spacing in the range of 1/2" to 2", and wherein the slits are configured with interlocking seams for a linear press-closure which holds together by interference between two linear elements of either side of the seal such that the slit can be partially closed to tighten the slit upon the shank of the hair.

8. A method of treating hair, comprising steps of:

a. Placing a head cap over the hair of the person whose hair is to be colored, wherein said cap is made of plastic, foam, or rubber, or waterproof fabric, wherein said cap is provided with a plurality of long narrow slits cut into the head cap such that shanks of hair can be pulled through any such slit for hair coloring, and wherein the slits are configured in two or more orientations, wherein the slits have length in the range of 1" to 4" and width in the range of 1/64" to 1/4", and wherein the slits are spaced apart with spacing in the range of 1/2" to 2", and wherein said slits are zig-zag shaped;

b. Pulling shanks of hair through said slits;

c. Treating said hair shank by coloring, frosting, foiling, bleaching or dying; and d. Repeating steps (b) through (c) until the hair is the treatment is done.

9. A method of treating hair, comprising steps of:

a. Placing a head cap over the hair of the person whose hair is to be colored, wherein said cap is made of plastic, foam, or rubber, or waterproof fabric, wherein said cap is provided with a plurality of long narrow slits cut into the head cap such that shanks of hair can be pulled through any such slit for hair coloring, and wherein the slits are configured in two or more orientations, wherein the slits have length in the range of 1" to 4" and width in the range of 1/64" to 1/4", and wherein the silts are spaced apart with spacing in the range of 1/2" to 2", and wherein said slits are zig-zag shaped and the slits are reinforced by one of the group selected from stitching the slits and adding thicker plastic around the silts;

b. Pulling shanks of hair through said slits;

c. Treating said hair shank by coloring, frosting, foiling, bleaching or dying; and d. Repeating steps (b) through (c) until the hair is the treatment is done.

10. A method of treating hair, comprising steps of:

a. Placing a head cap over the hair of the person whose hair is to be colored, wherein said cap is made of plastic, foam, or rubber, or waterproof fabric, wherein said cap is provided with a plurality of long narrow slits cut into the head cap such that shanks of hair can be pulled through any such slit for hair coloring, and wherein the slits are configured in two or more orientations, wherein the slits have length in the range of 1" to 4" and width in the range of 1/64" to 1/4", and wherein the slits are spaced apart with spacing in the range of 1/2" to 2", and wherein the slits are configured with interlocking seams for a linear press-closure which holds together by interference between two linear elements of either side of the seal such that the slit can be partially closed to tighten the slit upon the shank of the hair;

b. Pulling shanks of hair through said slits;

c. Treating said hair shank by coloring, frosting, foiling, bleaching or dying; and d. Repeating steps (b) through (c) until the hair is the treatment is done.

* * * * *